US005853163A

United States Patent [19]

Chagnot

[11] Patent Number: 5,853,163

[45] **Date of Patent: *Dec. 29, 1998**

[54] POST PLUMBING DEVICE

[76] Inventor: Brian Chagnot, 1300 McCabe Ave., P.O. Box 588, Coraopolis, Pa. 15108

[ * ] Notice: The term of this patent shall not extend beyond the expiration date of Pat. No. 5,622,354.

[21] Appl. No.: 832,604

[22] Filed: Mar. 31, 1997

Related U.S. Application Data

[63] Continuation-in-part of Ser. No. 572,083, Dec. 14, 1995, Pat. No. 5,622,354.

[51] Int. Cl.[6] ..... B66F 11/00

[52] U.S. Cl. ..... 254/100; 254/133 A; 254/133 R

[58] Field of Search ..... 254/100, 13, 20, 254/133 A, 133 R; 269/41, 43, 242; 52/127.2; 248/354.1

[56] References Cited

U.S. PATENT DOCUMENTS

| | | |
|---|---|---|
| 338,811 | 3/1886 | Whitaker . |
| 923,713 | 1/1909 | Schwarting . |
| 1,472,992 | 11/1923 | Roeglin . |
| 2,514,374 | 7/1950 | Cooper . |
| 2,636,716 | 4/1953 | Fudge . |
| 2,684,824 | 7/1954 | Hillberg . |
| 2,814,459 | 11/1957 | Hyre . |
| 2,832,559 | 5/1958 | Hillberg . |
| 2,850,254 | 12/1958 | Houseworth . |
| 2,863,207 | 12/1958 | Davis . |
| 2,945,662 | 7/1960 | Jennings . |
| 3,014,685 | 12/1961 | Jensen . |
| 3,574,981 | 4/1971 | Henschen . |
| 3,700,202 | 10/1972 | Donnels . |
| 3,743,330 | 7/1973 | Itatani . |
| 3,788,026 | 1/1974 | Cook . |
| 3,817,006 | 6/1974 | Williams . |
| 4,027,866 | 6/1977 | Ruggiero . |
| 4,070,833 | 1/1978 | Hancock . |
| 4,165,869 | 8/1979 | Williams . |
| 4,304,078 | 12/1981 | Meriwether . |
| 4,669,704 | 6/1987 | Abraham et al. . |
| 4,750,662 | 6/1988 | Kagimoto . |
| 4,752,157 | 6/1988 | Iscebeck et al. . |
| 4,944,123 | 7/1990 | Larrieu . |
| 5,228,262 | 7/1993 | Meriwether . |
| 5,377,462 | 1/1995 | Beals . |
| 5,393,036 | 2/1995 | Sheridan . |

*Primary Examiner*—Robert C. Watson
*Attorney, Agent, or Firm*—Buchanan Ingersoll, P.C.

[57] ABSTRACT

A post plumbing device has a pair of brackets connected by a threaded rod. Each bracket has a base having a selected length, a top, a bottom and four sides extending between the bottom and the top. A top flange is attached to the top and has a threaded bore passing through the flange, along an axis substantially parallel to the base. One bracket has a shorter side flange extending from a portion of one side of the base away from and substantially perpendicular to the bottom. A plurality of holes are provided in each base and the side flange to receive nails or screws. A threaded rod having a handle at its midpoint is threaded into the threaded bore of each of the brackets.

9 Claims, 6 Drawing Sheets

POST PLUMBING DEVICE

CROSS REFERENCE TO RELATED APPLICATION

This is a continuation-in-part of U.S. patent application Ser. No. 08/572,083 filed Dec. 14, 1995 now U.S. Pat. No. 5,622,354.

FIELD OF THE INVENTION

The invention relates to a tool for plumbing posts, door frames, stud walls and the like.

BACKGROUND OF THE INVENTION

During construction of a wood frame building it is necessary to align wall frames to be in a vertical position. The conventional manner of doing this is to first build a stud wall on the floor and then raise the stud wall to its proper position. One workman holds the wall while another uses a level to adjust it to a true vertical position. However, there are many situations in which only one workman is available to position and install a stud wall. Therefore, there is a need for a device which will assist a single workman in plumbing a stud wall. The device preferably should be suitable for use by do-it-yourself users who have had limited training and experience in carpentry work. To reach such a market it is necessary that the device be sturdy, easy to use and relatively inexpensive. Furthermore, the device should also be suitable for use in installing a single post or a door frame.

The art has developed a number of jacking devices to maintain a desired distance between studs or frame elements. Abraham et al. in U.S. Pat. No. 4,669,704 disclose an apparatus for jacking basement walls comprised of two threaded rods connected into a threaded sleeve. The device is telescopable by turning a wheel or handle on the threaded sleeve which causes the threaded shafts to move inward or outward. A similar device is disclosed by Ischebeck et al. in U.S. Pat. No. 4,752,157.

Jenson et al. in U.S. Pat. No. 3,014,685 disclose a device for securing concrete forms which has two spaced apart L-shaped members separated by a threaded rod and nuts. This device is useful for pushing two frame members apart from one another. However, the device cannot be used for aligning a single post.

There are also a variety of adjustable braces which have been developed for masonry construction. Such devices are disclosed in U.S. Pat. No. 2,832,559 to Hillberg, U.S. Pat. No. 2,684,824 to Hillberg, U.S. Pat. No. 4,070,833 to Hancock, U.S. Pat. No. 5,337,462 to Beals et al. and U.S. Pat. No. 2,945,662 to Jennings. While these devices are suitable for masonry construction they are unsuitable for wood frame construction because they are very large, heavy, complicated and expensive.

Thus, there is a need for a simple, inexpensive tool that can be used by one person for positioning and plumbing stud walls and posts.

SUMMARY OF THE INVENTION

I provide a simple, inexpensive post plumbing device in which there are a pair of brackets separated by a threaded rod connected to a threaded bore in each of the brackets. Each bracket has a base having a top flange extending from the top surface of the base. The top flange has a threaded bore through which the threaded rod passes. Additionally, at least one bracket has a side flange extending from one side of the base. The side flange is adjacent and substantially perpendicular to the bottom of the base. Each of the brackets can be identical except for the side flange and the thread cut through the top flange. Thus, the device can be an inexpensive casting. A handle is attached to the threaded rod for rotating the rod to open and close the brackets.

I prefer to provide a large hole in the base through which a stake can be driven. I also prefer to provide nail holes in both the base and the side flange for tacking the brackets to a stud.

Other objects and advantages of the invention will become apparent from a description of the preferred embodiments shown in the drawings.

DESCRIPTION OF THE PREFERRED EMBODIMENT

Figure 1:
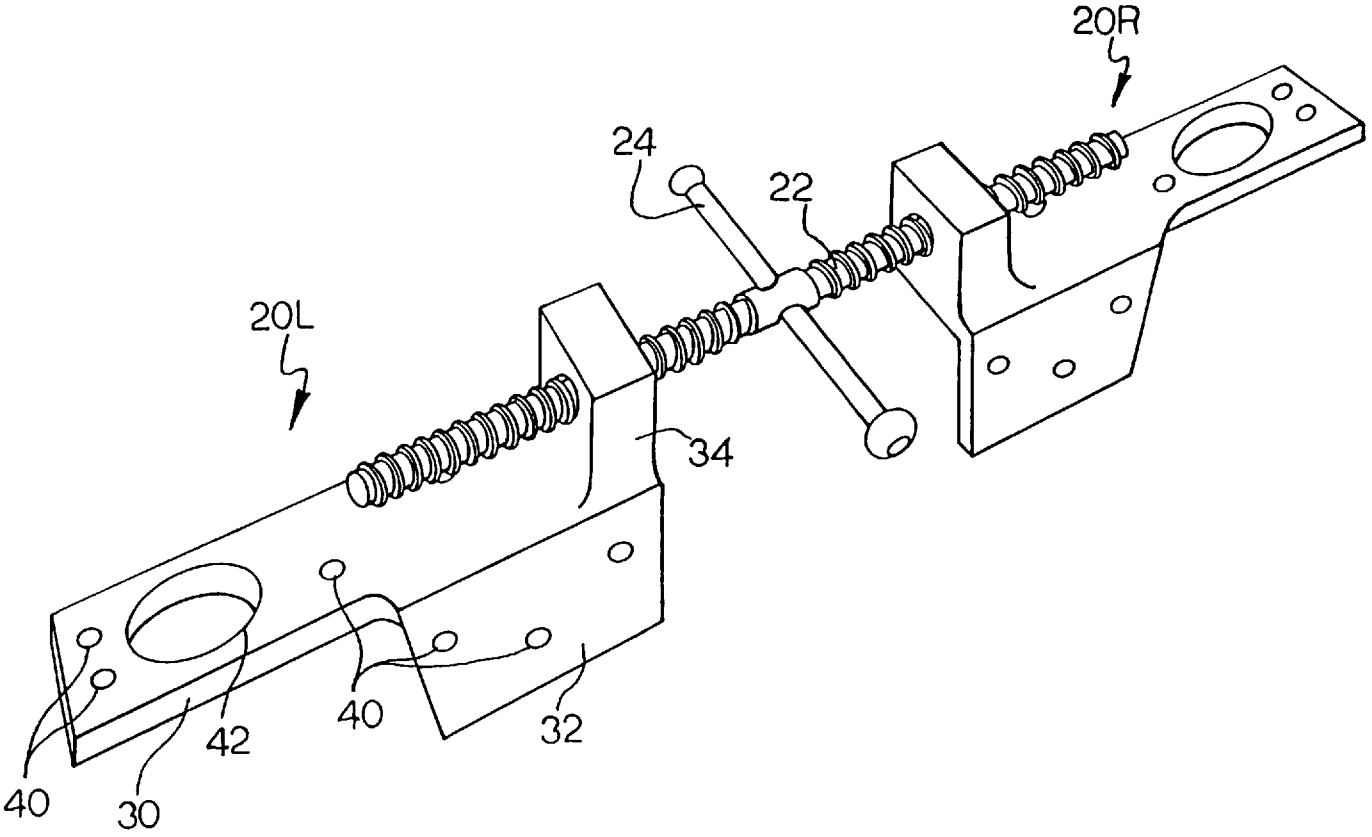
FIG. 1 is a perspective view of a present preferred embodiment of my post plumbing device.

My post plumbing device consists of four basic parts shown connected in FIG. 1. A left bracket 20L and right bracket 20R are connected by threaded rod 22 having a handle 24 attached thereto. Each bracket is comprised of a base 30 having a top flange 34 extending from the top surface of the base. The top flange is threaded to receive threaded rod 22. A side flange 32 extends from one side of the base and is perpendicular to the bottom surface of the base 30. The side flange 32 is shorter than the base so that the bracket can be easily attached to a wall stud as shown by device 54 on door frame 45 in FIG. 2. An edge of flange 32 abuts the side of the door frame 45 while the bottom of the bracket abuts the face of the door frame. I prefer to provide holes 40 in the base and side flange for receipt of nails or screws. Also, I prefer to provide a larger post hole 42 in the base. In the embodiment shown in FIG. 1 bracket 20L is a mirror image of bracket 20R. However, one could use the same bracket for both the left and right brackets provided that the top flange 34 of each bracket is oppositely threaded.

Figure 2:
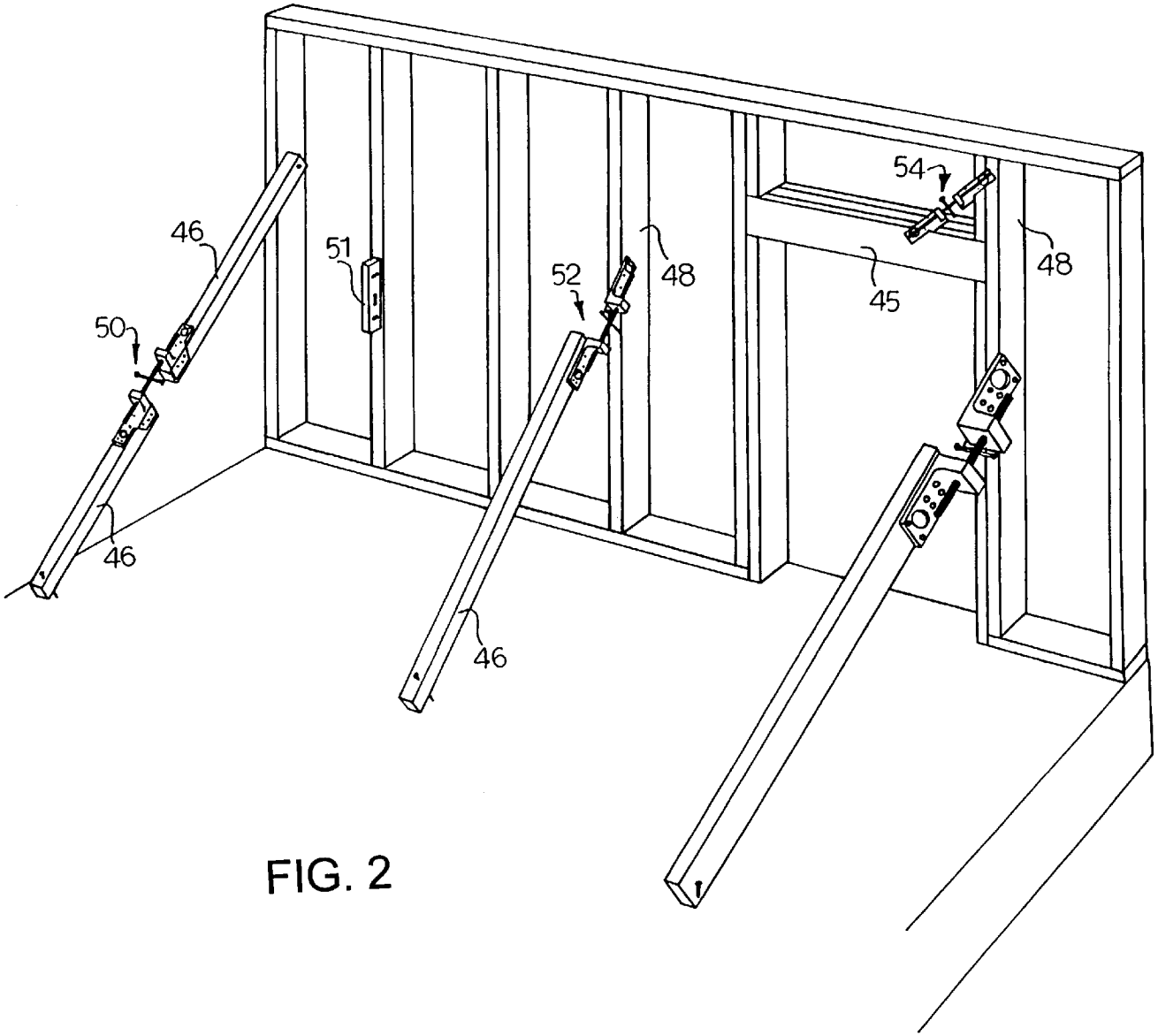
FIG. 2 is a perspective view showing how my post plumbing device can be used to plumb a stud wall.
Figure 4:
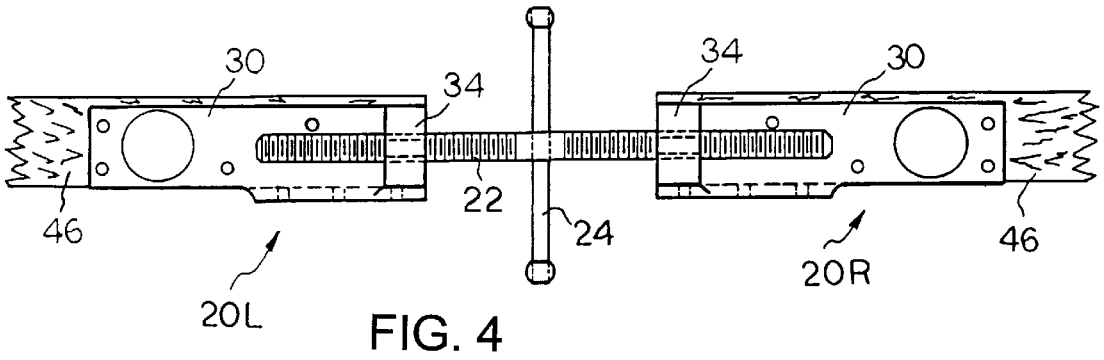
FIG. 4 is a top plan view of the embodiment of FIG. 1 attached to two boards.
Figure 5:
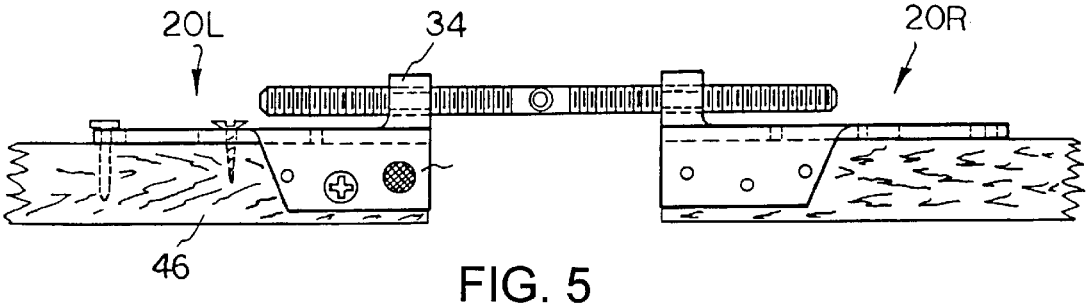
FIG. 5 is a side view of the embodiment shown in FIG. 4.

In FIG. 2 one post plumbing device 50 identical to the embodiment of FIG. 1 is connected to two 2×4 inch boards 46. One of the brackets is connected by nails or screws to one end of each 2×4 as shown more clearly in FIGS. 4 and 5. The opposite end of each board is nailed to the floor or stud wall as shown in FIG. 2. By turning the handle on the threaded rod one can move the stud wall forward or backward until it is in a proper vertical position. This position can be confirmed by placing a level 51 or plumb bob (not shown) against one of the studs. I prefer that the width of the base 30 and side flange 32 be shown to easily fit over and extend across a 2×4 stud as shown in FIGS. 4 and 5.

In an alternative arrangement, a second post plumbing device 52 is attached to wall stud 48 using only a single board 46. One bracket is attached to the board while the second bracket is attached directly to the stud wall. Another one of my post plumbing devices 54 is placed to square-up a door frame. There the device is connected between the top of the door frame 45 and adjacent wall stud 48.

Side flange 32 assures that the top and side of the two pieces of wood 46 are in the same plane. By snugly fitting the brackets on each piece of wood 46, the workman is able to assure that there is no misalignment of the brace formed by the plumbing device 50 and boards 46.

Figure 3:
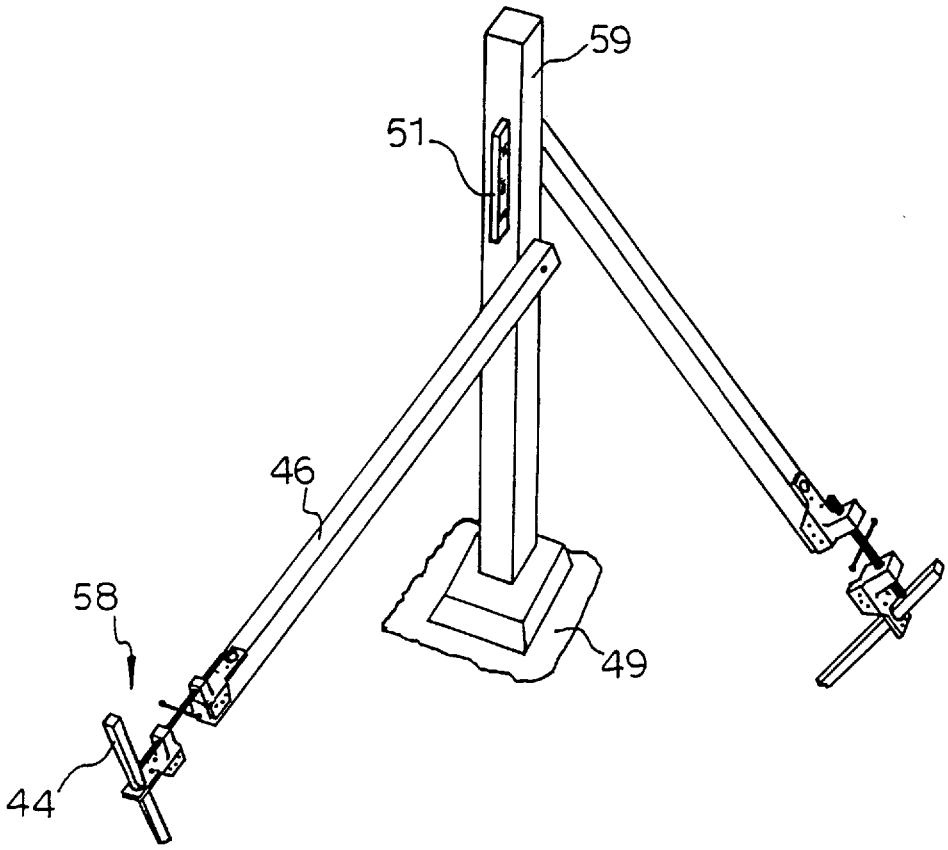
FIG. 3 is a perspective view showing how my post plumbing device can be used to plumb a single post.

My device can also be used to plumb a single post 59 as shown in FIG. 3. There one bracket of the post plumbing device 58 is attached to a piece of wood 46. The opposite end of that piece of wood is nailed to the post 59. A stake 44 is driven through a large hole in one bracket. As shown in FIG. 3, I prefer to use two devices attached to the post 59 at right angles. By adjusting the threaded rod post 59 can be positioned in true vertical alignment. When so positioned, the post is secured into the ground such as by pouring concrete 49 around the base of the post.

Figure 6:
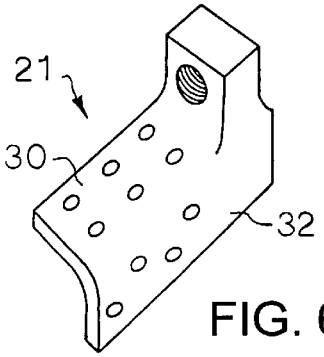
FIG. 6 is a perspective view of a second present preferred bracket.
Figure 7:
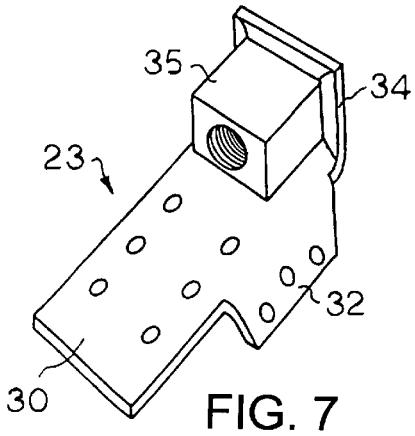
FIG. 7 is a perspective view of a third present preferred bracket.
Figure 8:
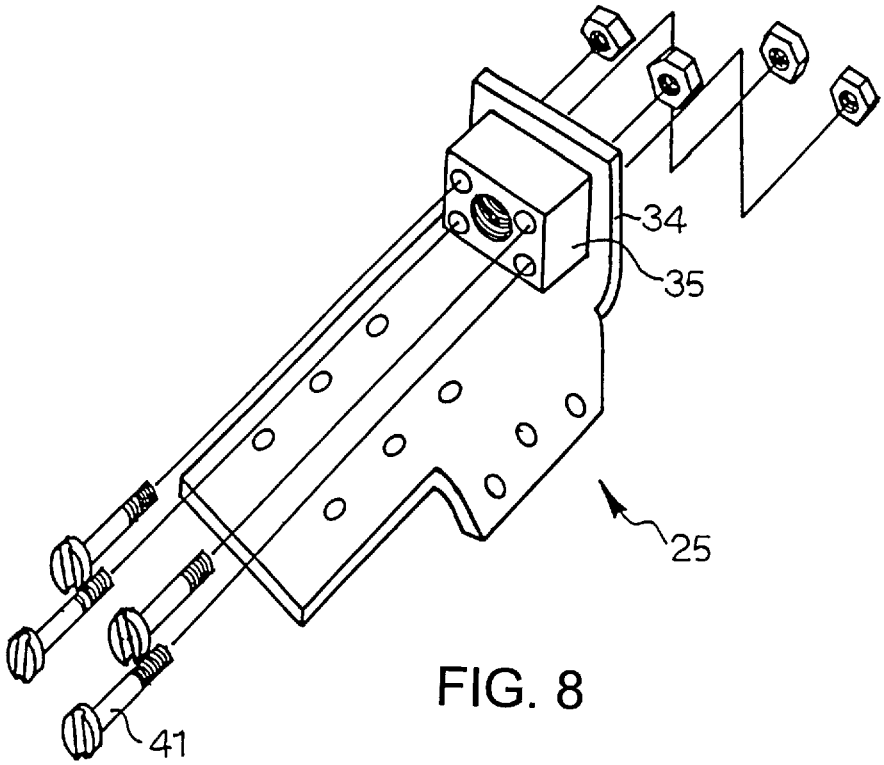
FIG. 8 is a perspective view of a fourth present preferred bracket.

The bracket 21 shown in FIG. 6 is shaped to be a metal casting or a molded plastic structure formed as a single piece. Another embodiment of the bracket 23 is shown in FIG. 7. That bracket 23 is a metal stamping wherein the side flange 32 and top flange 34 are bent to be perpendicular to the base 30. A threaded nut 35 is welded to the top flange 34. A similar bracket 25 shown in FIG. 8 can be made by bolting a large nut 35 onto the top flange 34 using bolts 41.

Figure 9:
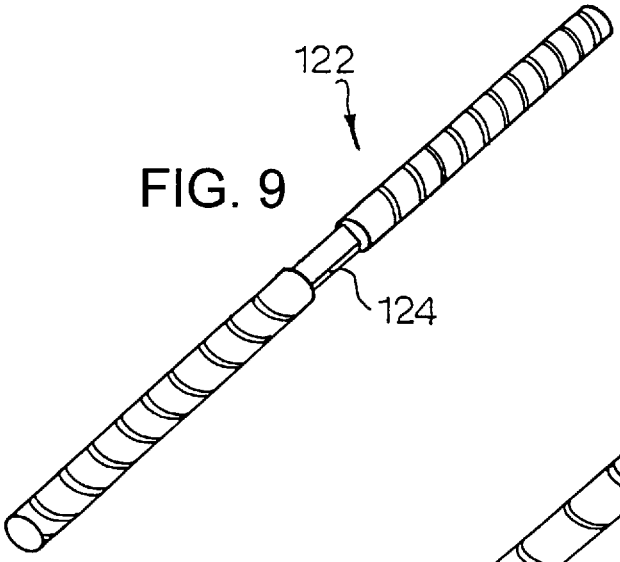
FIG. 9 is a perspective view of a second present preferred threaded rod.
Figure 10:
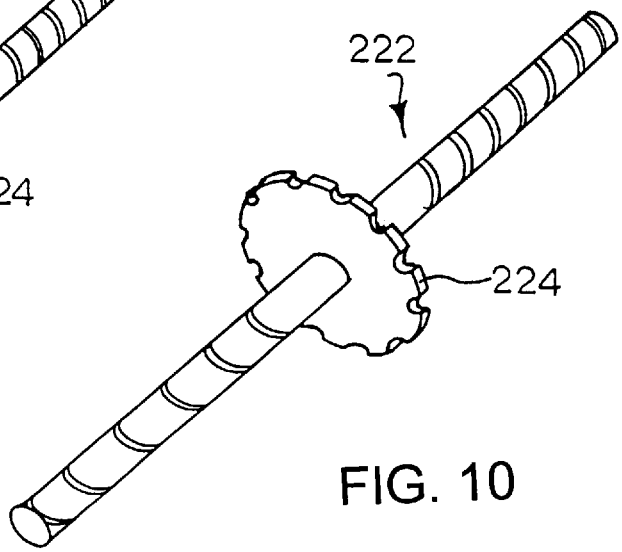
FIG. 10 is a perspective view of a third present preferred threaded rod.

Alternative configurations of the threaded rod are shown in FIGS. 9 and 10. The first embodiment 122 has a portion 124 with a square cross section that can be gripped with a wrench. The second embodiment 222 has a center wheel 224 which is used to turn the rod.

Figure 11:
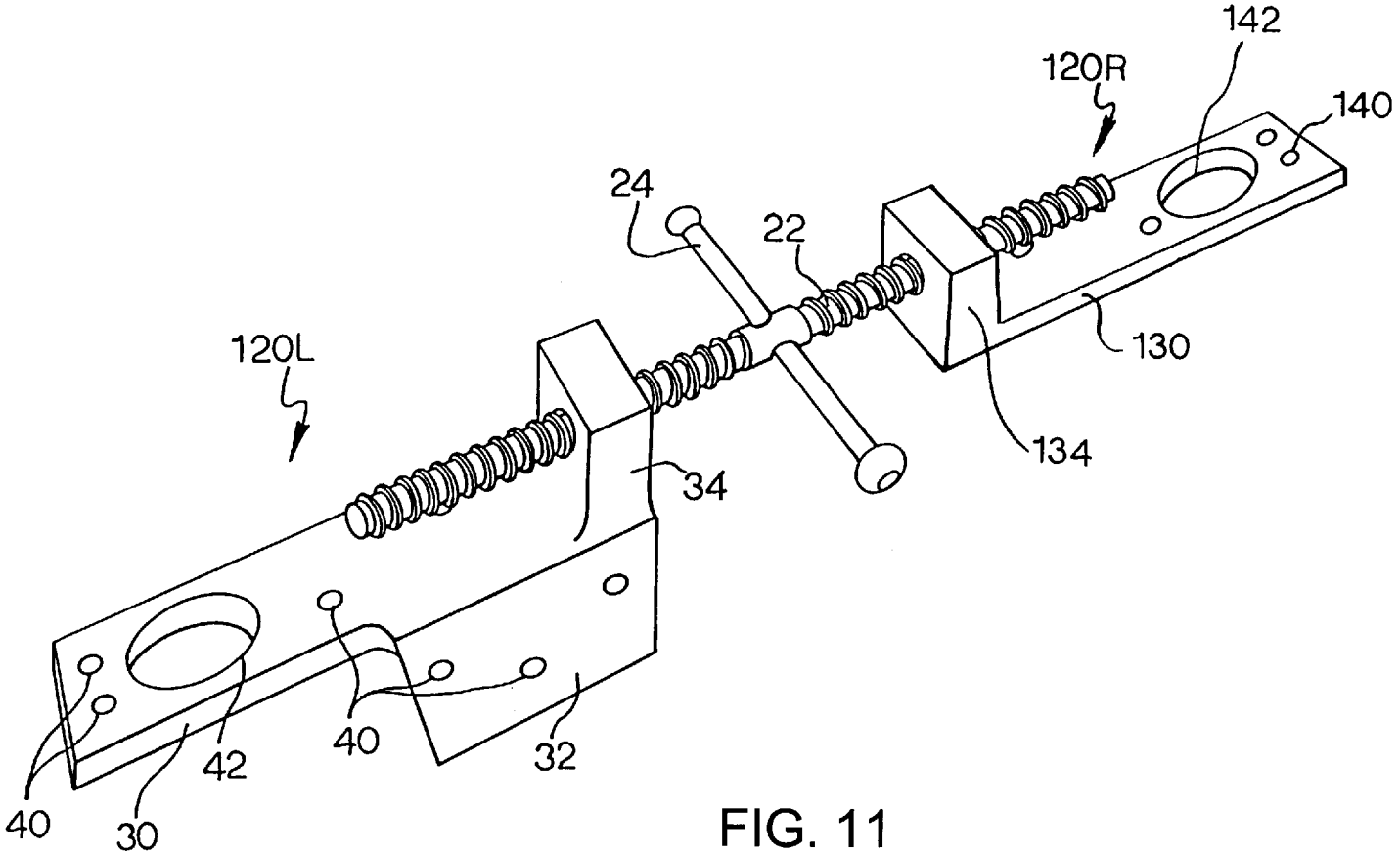
FIG. 11 is a perspective view of a fifth present preferred bracket.

In the fifth embodiment shown in FIG. 11, the left bracket 120L is identical to the left bracket in the first embodiment shown in FIGS. 1 through 5. There is a base 30 having a top flange 34 threaded to receive threaded rod 22. A side flange 32 extends from one side of the base 30 and is perpendicular to the bottom surface of the base. Preferably small holes 40 are provided in the side flange 32 and the base 30. An optional larger post hole 42 is also provided. The right bracket 120R is different from the prior embodiments because it has no side flange. Top flange 134 extends from the top of base 130 and receives threaded rod 22. Small holes 140 are provided in the base 130. I prefer to provide a larger post hole 142 in the base 130. Like the left bracket, the right bracket 142 may be a metal casting or stamping or could be a plastic molded part.

All of the embodiments of my post plumbing device are inexpensive to make and easy to use. Consequently, a builder may purchase several devices. Many devices could be used and left in place as construction proceeds, for further adjustment as necessary. When not in use, several devices can be easily stored in a small place.

No special tools are needed to make or use any post plumbing device. Indeed, nearly every builder would know how to use the product without directions.

Even though I have shown the device being used to plumb posts and stud walls it could also be used to shift or position pipes or electrical conduit. The device could also be used in other situations where bracing is needed.

Although I have shown certain present preferred embodiments of my post plumbing device it should be distinctly understood that the invention is not limited thereto, but may be variously embodied within the scope of the following claims.

I claim:

1. A post plumbing device comprising:

a. a first bracket comprised of
   i. a base having a top, a bottom and sides extending between the bottom and the top;
   ii. a side flange extending from one side away from and substantially perpendicular to the bottom;
   iii. a top flange attached to the top and having a threaded bore passing through the top flange, along an axis substantially parallel to the base; and
   iv. a plurality of holes in at least one of the base and the side flange to receive nails or screws;

b. a second bracket comprised of
   i. a base having a top, a bottom and sides extending between the bottom and the top;
   ii. a top flange attached to the top and having a threaded bore passing through the top flange along an axis substantially parallel to the base; and
   iii. a plurality of holes in the base to receive nails or screws; and c. a threaded rod connected to the threaded bore of each bracket.

2. The post plumbing device of claim 1 wherein the brackets are oppositely threaded.

3. The post plumbing device of claim 1 wherein the base of at least one bracket has a post hole passing therethrough.

4. The post plumbing device of claim 1 also comprising a threaded nut attached to the top flange and aligned with the hole through the top flange.

5. The post plumbing device of claim 4 wherein the nut is welded to the top flange.

6. The post plumbing device of claim 4 wherein the nut is attached to the top flange by bolts.

7. The post plumbing device of claim 1 wherein the brackets are metal stampings.

8. The post plumbing device of claim 1 wherein the threaded rod has a segment spaced from each end of the rod which has a square cross-section.

9. The post plumbing device of claim 1 also comprising a handle attached to the threaded rod between and spaced apart from its distal ends.

* * * * *